US008195075B2

(12) United States Patent
Yoshinaga et al.

(10) Patent No.: US 8,195,075 B2
(45) Date of Patent: Jun. 5, 2012

(54) FIXING UNIT HAVING A RESIN SURFACE AND IMAGE FORMING APPARATUS USING THE SAME

(75) Inventors: Hiroshi Yoshinaga, Chiba-ken (JP); Takayuki Yoshii, Kanagawa-ken (JP); Kohji Kamiya, Kanagawa-ken (JP); Masanao Ehara, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 11/898,130

(22) Filed: Sep. 10, 2007

(65) Prior Publication Data

US 2008/0063443 A1 Mar. 13, 2008

(30) Foreign Application Priority Data

Sep. 11, 2006 (JP) ..... 2006-245878

(51) Int. Cl.
*G03G 15/20* (2006.01)

(52) U.S. Cl. ..... 399/328; 399/333

(58) Field of Classification Search ..... 399/328, 399/333, 329
See application file for complete search history.

(56) References Cited

U.S. PATENT DOCUMENTS 5,164,782 A * 11/1992 Nagayama et al. ..... 399/320
5,243,393 A * 9/1993 Menjo ..... 399/325
5,978,640 A * 11/1999 Segawa ..... 399/327
6,001,440 A * 12/1999 Miyamoto et al. ..... 428/36.9
6,009,300 A * 12/1999 Kagawa et al. ..... 399/333
6,625,417 B1 9/2003 Terada et al.
7,056,578 B2 * 6/2006 Pickering et al. ..... 428/327
7,459,203 B2 * 12/2008 Pickering ..... 428/212
2002/0018663 A1 2/2002 Furukawa et al.
2002/0067936 A1 6/2002 Yasui et al.
2002/0102118 A1 * 8/2002 Kosugi et al. ..... 399/341
2003/0063934 A1 * 4/2003 Takenaka et al. ..... 399/333
2003/0118770 A1 * 6/2003 Suwa et al. ..... 428/41.5
2003/0127173 A1 7/2003 Kamiya et al.
2003/0152406 A1 8/2003 Terada et al.
2003/0170055 A1 9/2003 Terada et al.
2003/0210933 A1 11/2003 Mouri et al.
2003/0223788 A1 12/2003 Tateishi et al.
2003/0235417 A1 12/2003 Aze et al.
2004/0081490 A1 4/2004 Terada et al.
2004/0224165 A1 11/2004 Kondoh et al.

(Continued)

FOREIGN PATENT DOCUMENTS

CN 1349620 5/2002

(Continued)

OTHER PUBLICATIONS

Computer translation of JP2002-268428A to Otake et al.; Sep. 18, 2002.*

(Continued)

*Primary Examiner* — Quana M Grainger
(74) *Attorney, Agent, or Firm* — Harness, Dickey & Pierce, P.L.C.

(57) ABSTRACT

An image forming apparatus includes a fixing unit for fixing a toner image on a recording medium. In at least one embodiment, the fixing unit includes a fixing member configured to heat and melt a toner. Further, in at least one embodiment, the fixing member has a surface contacting the toner image and includes a wettability not greater than 38 mN/m.

19 Claims, 6 Drawing Sheets

U.S. PATENT DOCUMENTS

| | | | | |
|---|---|---|---|---|
| 2005/0025539 | A1 | 2/2005 | Yoshinaga | |
| 2005/0089787 | A1* | 4/2005 | Uchinokura et al. | 430/124 |
| 2005/0207806 | A1 | 9/2005 | Yoshii et al. | |
| 2005/0226661 | A1* | 10/2005 | Ohmura et al. | 399/333 |
| 2005/0271434 | A1* | 12/2005 | Maeda | 399/333 |
| 2005/0276638 | A1* | 12/2005 | Yamada | 399/323 |
| 2006/0165443 | A1 | 7/2006 | Yoshinaga et al. | |
| 2006/0165448 | A1 | 7/2006 | Yoshinaga | |
| 2007/0059058 | A1* | 3/2007 | Ito et al. | 399/323 |

FOREIGN PATENT DOCUMENTS

| | | | |
|---|---|---|---|
| CN | 1444112 | | 9/2003 |
| CN | 1462912 | | 12/2003 |
| JP | 05147126 | A * | 6/1993 |
| JP | 05158368 | A * | 6/1993 |
| JP | 05-232830 | | 9/1993 |
| JP | 8-152019 | | 6/1996 |
| JP | 10-171265 | | 6/1998 |
| JP | 10-213988 | | 8/1998 |
| JP | 10-333464 | | 12/1998 |
| JP | 2001-330983 | | 11/2001 |
| JP | 2002268428 | A * | 9/2002 |
| JP | 2002287400 | A * | 10/2002 |
| JP | 2003005420 | A * | 1/2003 |
| JP | 2003-215969 | | 7/2003 |
| JP | 2003-270990 | | 9/2003 |
| JP | 2004102192 | A * | 4/2004 |
| JP | 2004-286804 | | 10/2004 |
| JP | 2005-049445 | | 2/2005 |
| JP | 2005066915 | A * | 3/2005 |
| JP | 2007276387 | A * | 10/2007 |

OTHER PUBLICATIONS

Office Action for corresponding Chinese patent application No. 200710154227.1 dated Jul. 13, 2011.

Office Action for counterpart Chinese patent application No. 2007101542271 dated Jan. 22, 2010.

* cited by examiner

FIXING UNIT HAVING A RESIN SURFACE AND IMAGE FORMING APPARATUS USING THE SAME

PRIORITY STATEMENT

The patent application is based on and claims priority under 35 U.S.C. §119 upon Japanese Patent Application No. JP2006-245878 filed on Sep. 11, 2006 in the Japan Patent Office, the entire contents of which are hereby incorporated herein by reference.

BACKGROUND

1. Field

Example aspects of the present invention generally relate to an image forming apparatus, for example a copier, a printer, a facsimile and a multifunctional machine; and more particularly relate to an image forming apparatus including a fixing apparatus.

2. Discussion of the Background

Conventionally, in a fixing apparatus of an image forming apparatus such as a copier, a printer and the like, a nip portion is formed by abutting a fixing member, for example, a fixing roller, a fixing belt and a heat-resistant film against a pressure member, for example a pressure roller, a pressure belt and a heat-resistant film.

A recording medium is transported to the nip portion so that a toner image on the recording medium is fixed. Such a fixing apparatus has been widely used.

In such a fixing apparatus, it has been known that toner may electrostatically adhere to the surface of the fixing member. This phenomenon is so-called an electrostatic offset.

The electrostatic offset is a state in which toner or the toner image carried on the recording medium before a fixing process is electrostatically attracted to the surface of the fixing member.

The degree of attraction of toner or the toner image depends largely on the surface characteristics of the fixing member.

When the electrostatic offset is generated, the toner image adhered to the fixing member may be retransferred onto the recording medium after the fixing member rotates once. Consequently, a residual image may be formed.

Furthermore, the toner image adhered on the surface of the fixing member may be fixed to the fixing member each time the fixing member rotates. Consequently, a fixing failure may occur each time the fixing member rotates.

The problem described above, for example, has become a substantive problem for the image forming apparatus using oil-less toner of which demand has been increased recently.

In other words, in the image forming apparatus or the fixing apparatus using the oil-less toner a release agent is not necessarily applied on the surface of the fixing member. Consequently, the electrostatic offset may easily occur.

According to one related art, in order to suppress generation of the electrostatic offset by securing releaseability with a minimum amount of release agent, a narrow groove is provided in the fixing member, for example, a fixing belt in parallel with a sheet conveyance direction.

In one related art, in order to suppress gloss unevenness in an image, a material and a thickness of a surface layer of the fixing member are defined. The surface roughness (Rz) of the fixing member is formed to be no more than 1 μm, and the surface smoothness is optimized.

In one related art, in order to prevent contamination of the fixing member, ways in which the wettability of inorganic particulate contained in toner is optimized are proposed.

In one related art, in order to enhance the releasability of toner on the surface of the fixing member, a filler having affinity relative to the release agent is included in the fluoroethylene resin of the surface of the fixing member.

In one related art, in order to enhance the releasability of toner on the surface of the fixing member, fine asperities are formed on the fluoride polymer surface of the fixing member by way of sputter etching.

Furthermore, according to a related art, in order to prevent contamination of the fixing member, ways in which a surface tension (measured by a method disclosed in Japanese Industrial Standard K6768, the entire content of which are hereby incorporated herein by reference) of the fluoride polymer surface layer is in a range between 25 and 50 dyne/cm are proposed.

However, in the above-described related arts, it has been difficult to suppress the electrostatic offset with a relatively simple structure. When using the oil-less toner, the electrostatic offset has become a substantive problem.

Specifically, when providing a small groove in the fixing member, it takes time and is costly to manufacture the fixing member.

When the silicone oil serving as a release agent is applied on the surface of the fixing member, a desirable wettability may be achieved. Accordingly, gloss unevenness may be prevented.

On the other hand, when using the oil-less toner, the release agent is not applied on the surface layer of the fixing member. Consequently, the effect may be insufficient.

Furthermore, even if the surface roughness (Rz) of the fixing member is optimized, the electrostatic offset may not completely be suppressed.

In the above described related art, even if the wettability of the inorganic particulate in toner is defined, it may not be applicable to all kinds toner. Thus, a desirable releasability and durability may not be secured relative to all apparatuses.

In the above described related art, a desirable wettability may be achieved by using the silicone oil serving as a release agent applied on the surface layer of the fixing member. Accordingly, the releasability of toner of the fixing member may be enhanced.

However, when using the oil-less toner, the release agent is not applied to the surface layer of the fixing member. Consequently, a sufficient effect may not be achieved.

In the above described related art, toner may be adhered to the fine asperities formed on the fixing member.

Furthermore, in the above described related art, a desirable wettability may be achieved by using the silicone oil serving as a release agent applied on the surface layer of the fixing member so that contamination of the fixing member may be prevented.

However, when using the oil-less toner, the release agent is not applied to the surface layer of the fixing member. Consequently, a sufficient effect may not be achieved.

SUMMARY

In view of the foregoing, at least one example embodiment of the present invention provides an image forming apparatus which includes a fixing unit.

An example embodiment according to the present invention provides a fixing unit for fixing a toner image on a recording medium. The fixing unit includes a fixing member configured to heat and melt a toner. The fixing member has a surface contacting the toner image and having wettability not greater than 38 mN/m when measured by a method disclosed in JIS K6768.

In example embodiments, the fixing member is a fixing roller, a fixing belt or a heat-resistant film.

In example embodiments, the fixing unit further includes a pressure member configured to come into contact with the fixing member to form a nip. The pressure member has a surface contacting the fixing member and having wettability not greater than 38 mN/m when measured by a method disclosed in JIS K6768.

In example embodiments, the pressure member is a pressure roller, a pressure belt or a heat-resistant film.

In example embodiments, the fixing unit further includes an oil applicator configured to apply an oil to the surface of the pressure member.

In example embodiments, the fixing unit further includes a main power source connected to a commercial power source and an auxiliary power source configured to charge and discharge an electric power. The electric power is supplied from at least one of the main power source and the auxiliary power source.

In example embodiments, the toner is prepared by the following method:

dissolving or dispersing toner constituents including a pigment colorant, a prepolymer including a modified polyester resin, and a compound capable of elongating or crosslinking the prepolymer in an organic solvent, to prepare a toner constituent solution or dispersion;

dispersing the toner constituent solution or dispersion in an aqueous medium, while subjecting the prepolymer and the compound to an elongation and/or a crosslinking reaction, to prepare a toner dispersion; and removing the organic solvent from the toner dispersion.

The pigment colorant has a number average dispersion particle diameter of not greater than 0.5 μm, and a content ratio of particles having a particle diameter of not less than 0.7 μm not greater than 5 percent.

In example embodiments, the pigment colorant has the number average dispersion particle diameter of not greater than 0.3 μm, and has the content ratio of particles having a particle diameter of not less than 0.5 μm not greater than 10 percent.

In example embodiments, the toner constituents further include a polyester resin unreactive to amine.

In example embodiments, the following relationships are satisfied:

$$3.0 \leqq Dv \leqq 7.0 \text{ and}$$

$$1.00 \leqq Dv/Dn \leqq 1.20$$

wherein Dv (μm) is the volume average particle diameter of the toner, and Dn (μm) is the number average particle diameter thereof.

In example embodiments, the toner has a circularity of 0.900 to 0.960.

In example embodiments, tetrahydrofuran-soluble components of the polyester resin in the toner have a molecular weight distribution having a main peak in a range of 2500 to 10000, and a number average molecular weight in a range of 2500 to 50000.

In example embodiments, the polyester resin has a glass transition temperature of 40 to 65 degree C. and an acid value of 1 to 30 mgKOH/g.

An example embodiment according to the present invention provides an image forming apparatus including: a photosensitive drum; a charger configured to charge the photosensitive drum; a writing unit configured to irradiate the photosensitive drum to form an electrostatic latent image thereon; a developing unit configured to develop the electrostatic latent image with a developer comprising a toner to form a toner image on the photosensitive drum; a transfer unit configured to transfer the toner image onto a recording medium; and the above-mentioned fixing unit.

In example embodiments, the image forming further includes a developing unit configured to store developer including carriers and the toner, and to develop an electrostatic latent image formed on the photosensitive drum.

In example embodiments, the developer includes a toner and a carrier.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
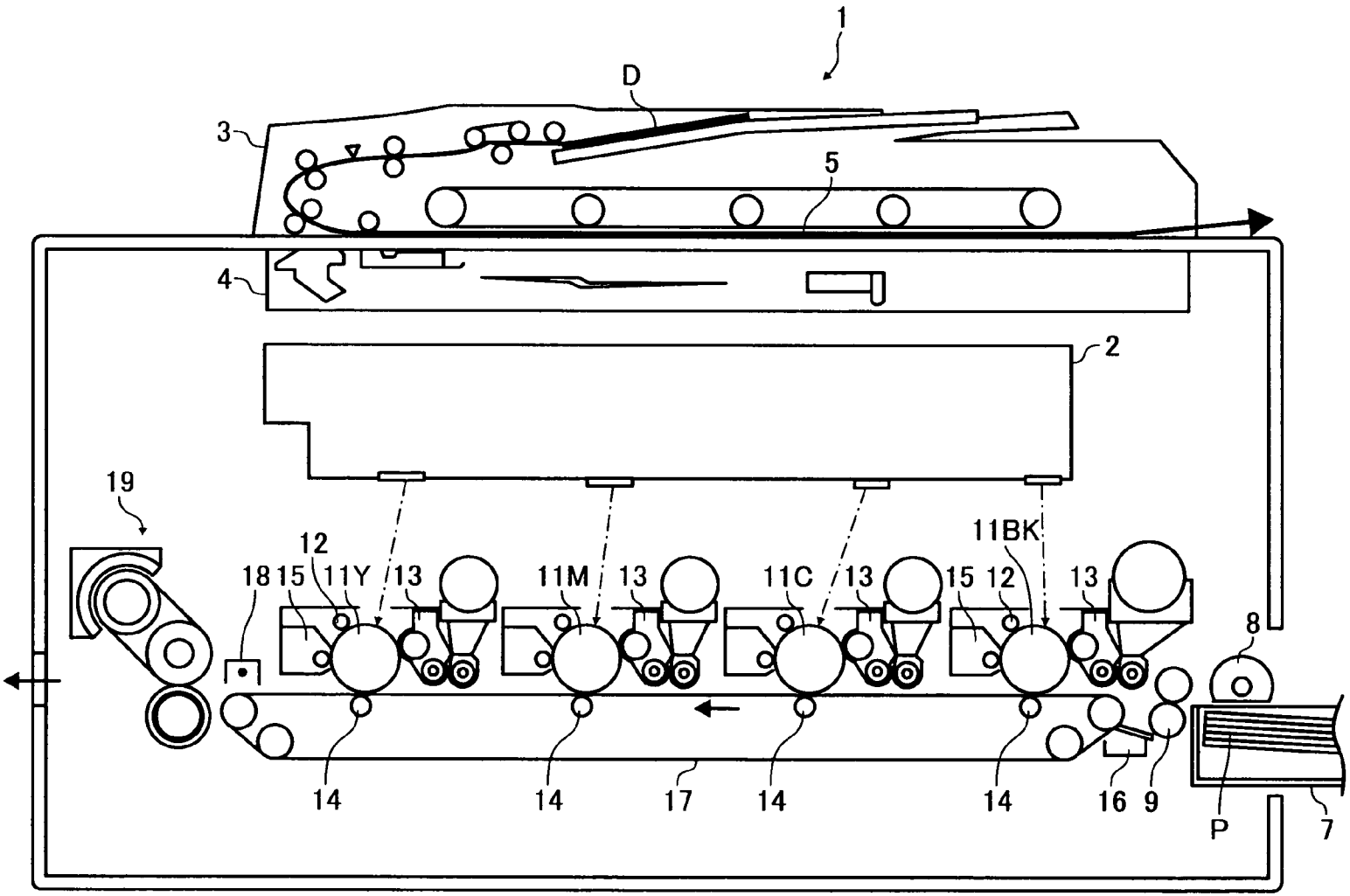
FIG. 1 is a schematic diagram illustrating an image forming apparatus according to one example embodiment of the present invention.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on," "directly connected to" or "directly coupled to" another element or layer, then there are no intervening elements or layers present. Like numbers refer to like elements throughout figures. As used herein, the term "and/or" includes any and all combinations of one or more of the associated listed items.

Spatially relative terms, such as "beneath," "below," "lower," "above," "upper" and the like, may be used herein for ease of description to describe an element or an element's feature or relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, the term such as "below" can encompass both an orientation of above and below.

The device may be otherwise oriented at various angles (i.e. rotated 90 degrees or at other orientations), and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Example embodiments of the present invention are now explained below with reference to the accompanying drawings.

In the later described comparative example, example embodiment, and alternative example, for the sake of simplicity of drawings and descriptions, the same reference numerals will be given to constituent elements such as parts and materials having the same functions, and the descriptions thereof will be omitted unless otherwise stated.

Typically, but not necessarily, paper is the medium from which is made a sheet on which an image is to be formed. Other printable media is available in sheets and their use here is included. For simplicity, this Detailed Description section refers to paper, sheets thereof, paper feeder, etc. It should be understood, however, that the sheets, etc., are not limited only to paper.

Referring now to the drawings, wherein like reference numerals designate identical or corresponding parts throughout the several views, particularly to FIG. 1, a structure of an image forming apparatus according to an example embodiment of the present invention is described.

With reference to FIGS. 1 through 6, a detailed description will be given of a first example embodiment of the present invention.

With reference to FIG. 1, a description will be given of a structure and an operation of the image forming apparatus 1, for example, a tandem-type color copier.

The image forming apparatus 1 may at least include: a writing unit 2, a document transportation unit 3, a document reading unit 4, a sheet feeder 7, a registration roller 9, photosensitive drums 11Y, 11M, 11C and 11BK, chargers 12, developing units 13, transfer bias rollers 14 and cleaning units 15.

The letter symbols Y, M, C and BK hereinafter denote colors of yellow, magenta, cyan and black, respectively.

The writing unit 2 emits a laser beam based on input image information. The transportation unit 3 transports a document D to the document reading unit 4. The document reading unit 4 reads the image information of the document D. The sheet feeder 7 stores a recording medium P, for example, a transfer sheet or any other desired recording medium. The registration roller 9 adjusts transportation timing of the recording medium P.

Toner images of different colors, yellow (Y), magenta (M), cyan (C), and black (BK) are formed on each of the photosensitive drums 11Y, 11M, 11C and 11BK, respectively.

The chargers 12 charge each surface of the photosensitive drums 11Y, 11M, 11C and 11BK.

The developing units 13 develop electrostatic latent images formed on the photosensitive drums 11Y, 11M, 11C and 11BK. The transfer bias rollers 14 overlay and transfer the toner images formed on each of the photosensitive drums 11Y, 11M, 11C and 11BK on one another onto the recording medium P.

The cleaning units 15 recover untransferred toner on the photosensitive drums 11Y, 11M, 11C and 11BK.

The image forming apparatus 1 may further include a transfer belt cleaning unit 16 for cleaning a transfer belt 17; the transfer belt 17 for transporting the recording medium P such that a plurality of the toner images are overlaid on one another on the recording medium P; and a fixing unit 19 of an electromagnetic induction heating type for fixing the toner images (unfixed images) on the recording medium P.

A description will be given of an operation of the image forming apparatus 1 when forming a color image.

First, the document D is transported from a document table by the transportation rollers of the document transportation unit 3 in a direction shown by an arrow.

Subsequently, the document D is placed on a contact glass 5 of the document reading unit 4. The image information of the document D placed on the contact glass 5 is optically read by the document reading unit 4.

The document reading unit 4 scans the document D on the contact glass 5 while irradiating the document D with the light emitted from a lighting unit. The light reflected on the document D is imaged on a color sensor through a group of mirrors and lenses.

Color separation of the color image information of the document D in RGB colors is performed and read by the color sensor. Subsequently, the color image information is converted into electric image signals.

Furthermore, based on the RGB image color separation signals, color conversion processing, color calibration processing, spatial frequency calibration processing and so forth may be performed in an image processing unit so that the color image information of yellow, magenta, cyan and black is obtained.

Subsequently, the image information of yellow, magenta, cyan and black is transmitted to the writing unit 2. The writing unit 2 emits laser beams or exposure lights according to the image information of the respective designated colors onto the respective photosensitive drums 11Y, 1M, 11C and 11BK.

The four photosensitive drums 11Y, 11M, 11C and 11BK rotate in a clockwise direction shown in FIG. 1. The surface of the photosensitive drums 11Y, 11M, 11C and 11BK is evenly charged at a position opposite to the chargers 12. This process is called a charting process.

Accordingly, a charting potential is formed on the photosensitive drums 11Y, 11M, 11C and 11BK. Subsequently, the surfaces of the charged photosensitive drums 11Y, 11M, 11C and 11BK arrive at a position to which the respective laser beams are emitted.

In the writing unit 2, the laser beams corresponding to the image signals are emitted from four light sources according to the respective designated color. Each laser beam passes different light paths of different color components of yellow, magenta, cyan and black. This process is so-called an exposure process.

The laser beam corresponding to a yellow component is emitted onto a surface of the photosensitive drum 11Y which is a first photosensitive drum from the left shown in FIG. 1. The laser beam having the yellow component is scanned by polygon mirrors which rotate in high-speed in a direction of rotary shaft of the photosensitive drum 11Y, that is, the main scanning direction.

Accordingly, an electrostatic latent image corresponding to the yellow component is formed on the surface of the photosensitive drum 11Y charged by the charger 12.

Similarly, the photosensitive drum 11M which is a second photosensitive drum from the left in FIG. 1 is irradiated with the laser beam corresponding to the magenta component. Accordingly, an electrostatic latent image corresponding to the magenta component is formed.

Similarly, the photosensitive drum 11C which is a third photosensitive drum from the left in FIG. 1 is irradiated with the laser beam corresponding to the cyan component. Accordingly, an electrostatic latent image corresponding to the cyan component is formed.

Similarly, the photosensitive drum 11BK which is a fourth photosensitive drum from the left in FIG. 1 is irradiated with the laser beam corresponding to the black component. Accordingly, an electrostatic latent image corresponding to the black component is formed.

Subsequently, each surface of the photosensitive drums 11Y, 11M, 11C and 11BK on which each respective color of the electrostatic latent images is formed arrives at a position opposite to the developing units 13.

Each developing unit 13 supplies toner of the respective designated color, which is oil-less toner, onto the photosensitive drums 11Y, 11M, 11C and 11BK so that the electrostatic latent images on the photosensitive drums 11Y, 11M, 11C and 11BK are developed. This process is so-called a developing process.

According to the first example embodiment, a two-component developer consisting of toner (oil-less toner) and carriers is stored in each of the developing units 13.

In the developing units 13, the toner and carriers are frictionally charged while agitated and mixed. Subsequently, the toner is electrostatically adhered to the electrostatic latent images on the photosensitive drums 11Y, 11M, 11C and 11BK.

Subsequently, the surface of the photosensitive drums 11Y, 11M, 11C and 11BK after the development process arrives at a position opposite to the transfer belt 17.

The transfer bias rollers 14 are disposed at each respective positions opposite to the photosensitive drums 11Y, 11M, 11C and 11BK such that the transfer bias rollers 14 abut an inner peripheral surface of the transfer belt 17.

Toner images of the respective designated colors formed on the photosensitive drums 11Y, 11M, 11C and 11BK are sequentially overlaid and transferred on one another on the recording member P on the transfer belt 17 at the transfer bias rollers 14. This process is so-called a transfer process.

Subsequently, the surface of the photosensitive drums 11Y, 11M, 11C and 11BK after the transfer process arrives at the position opposite to the cleaning units 15. Toner which has not been transferred and remained on the photosensitive drums 11Y, 11M, 11C and 11BK is recovered in the cleaning units 15. This process is so-called a cleaning process.

Subsequently, the surface of the photosensitive drums 11Y, 11M, 11C and 11BK passes a charge remover (not shown). Accordingly, a sequence of image processing is completed.

The recording medium P on which the toner images of the respective designated colors on the photosensitive drums 11Y, 11M, 11C and 11BK are sequentially overlaid and transferred is transported in the arrow direction and arrives at a position opposite to a separation charger 18.

Charge accumulated on the recording medium P is neutralized at the position opposite to the separation charger 18. Accordingly, the recording medium P is separated from the transfer belt 17 without generating toner debris or the like.

Subsequently, the surface of the transfer belt 17 arrives at the transfer belt cleaning unit 16. The transfer belt cleaning unit 16 recovers deposits adhered to the transfer belt 17.

A description will be given of the recording medium P. The recording medium P transported onto the transfer belt 17 is transported from the sheet feeder 7 by way of the registration rollers 9.

The recording medium P stored in the sheet feeder 7 is fed by the sheet feed roller 8 and passes a transportation guide (not shown). The recording medium P is led to the registration roller 9. The recording medium P reached at the registration roller 9 is sent to a position of the transfer belt 17 at an appropriate timing.

The recording medium P on which a full-color image is transferred is separated from the transfer belt 17 and is led to the fixing unit 19.

In the fixing unit 19, the color image or the color toner is fixed on the recording medium P at a position between the fixing belt and the pressure roller, that is, at a nip.

The recording medium P after the fixing processing is ejected out of the image forming apparatus 1 as an output image by a sheet eject roller (not shown). Accordingly, a sequence of image processing is completed.

Next, a description will be given of a structure and an operation of the fixing unit 19 disposed in the image forming apparatus 1.

Figure 2:
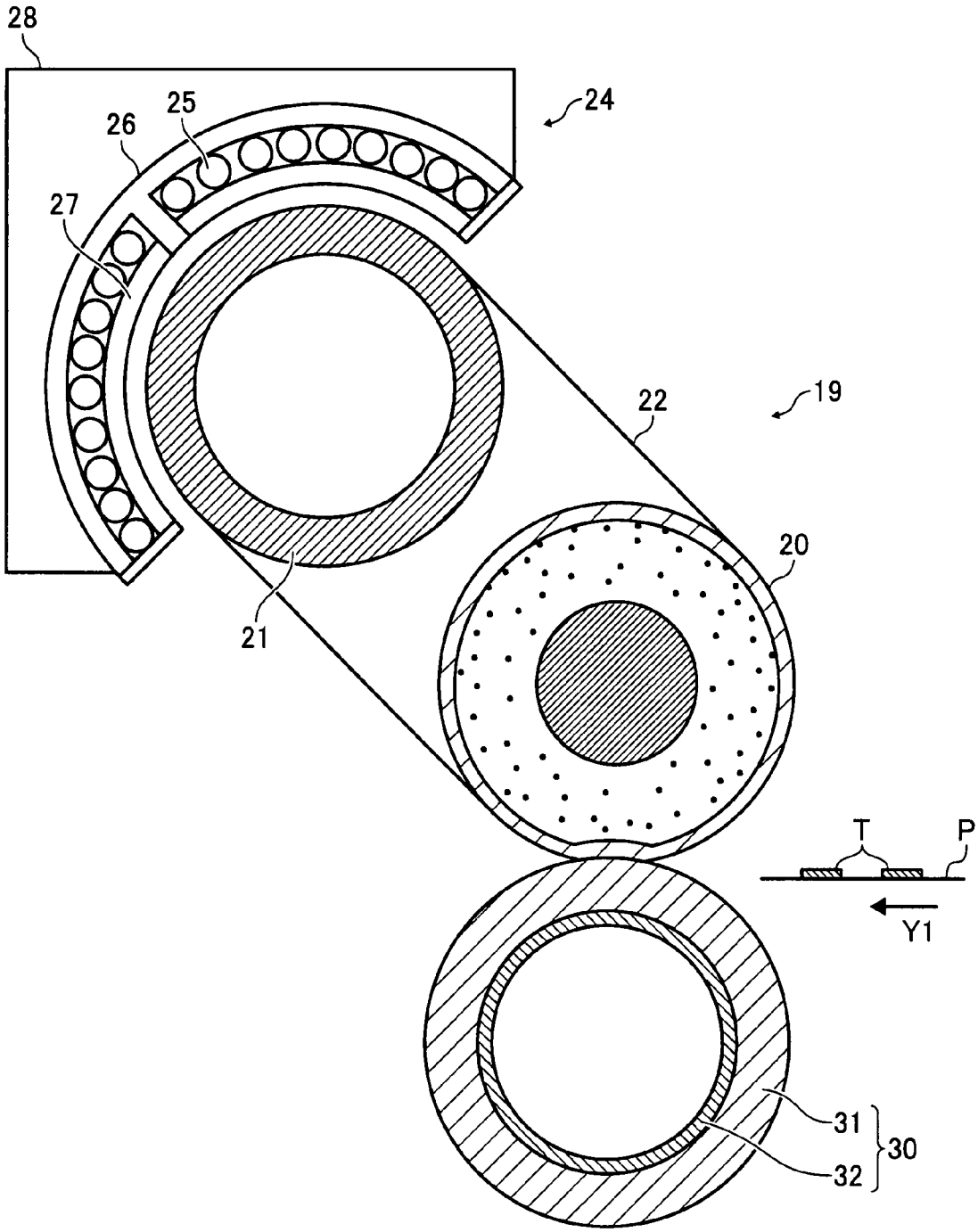
FIG. 2 is cross-sectional view illustrating a fixing unit disposed in the image forming apparatus of FIG. 1.

With reference to FIG. 2, the fixing unit 19 may at least include: a fixing auxiliary roller 20, a supporting roller 21, a fixing belt 22 serving as a fixing member, an induction heating unit 24, a pressure roller 30 serving as a pressure member, and so forth.

The fixing auxiliary roller 20 may include a metal shaft comprised of a stainless steel, for example. On the surface of the metal shaft, an elastic layer of silicone rubber or any other suitable material is formed.

The elastic layer of the fixing auxiliary roller 20 has a thickness of 1 to 5 mm and a hardness of 30 to 60 on the Asker C scale.

The supporting roller 21 may be formed of a hollow cylindrical member formed of a magnetic metal such as iron, cobalt, nickel or an alloy of these metals.

The supporting roller 21 may rotate in a clockwise direction in FIG. 2.

The supporting roller 21 may be heated by way of electromagnetic induction heating by the magnetic flux emitted from the induction heating unit 24.

The fixing belt 22 serving as a fixing member is spanned between two roller members: the supporting roller 21 and the fixing auxiliary roller 20. The fixing belt 22 may be an endless belt having a multilayered structure.

The multilayered structure may include, from an inner peripheral surface, an exothermic layer, an elastic layer, a separation layer and so forth laminated on one another.

Iron, cobalt or nickel, or an alloy of such metals, or any other suitable material may be used as a material for the exothermic layer of the fixing belt 22.

The elastic layer of the fixing belt 22 may be formed of a silicone rubber, a fluorosilicone rubber or any other suitable material. The thickness thereof may be 50 to 500 μm, and the hardness may be 5 to 50 on the Asker C scale.

Thereby, a uniform image quality without gloss unevenness may be achieved in the output image.

The release layer of the fixing belt may be formed of a fluoroethylene resin such as tetrafluorethene resin (PTFE), ethylene tetrafluoride-perfluoro alkyl vinyl ether copolymer resin (PFA), and ethylene tetrafluoride-propylene hexafluoride copolymer (FEP), or a mixture of such resins.

Alternatively, the release layer of the fixing belt 22 may be formed of a heat-resistant resin in which such resins are dispersed.

The thickness of the release layer 22*d* of the fixing belt 22 may be 5 to 50 μm, preferably, 10 to 30 μm. Thereby, the separation ability of toner on the fixing belt 22 may be secured. The flexibility of the fixing belt 22 may also be secured.

In addition, a primer layer or the like may be provided between each layer of the fixing belt 22.

The fixing belt 22 travels in the clockwise direction as shown FIG. 2. The fixing belt 22 or the exothermic layer thereof may be heated by way of electromagnetic induction heating by the magnetic flux emitted from the induction heating unit 24.

The fixing belt 22 according to the first example embodiment may serve as a fixing member which heats and fuses a toner image.

Furthermore, the fixing belt 22 may serve as an exothermic member which is directly heated by way of electromagnetic induction heating by the induction heating unit 24.

Furthermore, the fixing belt 22 may be indirectly heated by or receive heat from the supporting roller 21 heated by way of electromagnetic induction heating by the induction heating unit 24.

According to the first example embodiment, the wettablity (measured by a method disclosed in Japanese Industrial Standard K6768) of the surface of the fixing belt 22 serving as a fixing member is configured to be no greater than $38\times10^{-3}$ (N/m).

The surface of the fixing belt 22 herein refers to a peripheral surface which comes into contact with a toner image.

Thereby, in a case where the oil-less toner is used, the electrostatic offset is suppressed. The wettability of the fixing belt 22 will be described later with reference to FIG. 6.

According to the first example embodiment, the exothermic layer of the fixing belt 22 may have a single-layer structure formed of a magnetic metal material.

Alternatively, the exothermic layer of the fixing belt 22 may have a two-layer structure including a first non-magnetic layer and a second non-magnetic layer. In this case, non-magnetic stainless steel such as SUS304, SUS301 and SUS316 may be used for the first non-magnetic layer.

Copper (Cu), silver (Ag), aluminum (Al) and the like may be used for the second non-magnetic layer.

Furthermore, in order to prevent oxidization of the exothermic layer, a protective layer for preventing the exothermic layer from oxidization may be provided on the exothermic layer. The protective layer may be formed of nickel (Ni) or any other suitable material.

The induction heating unit 24 is provided facing the supporting roller 21 through the fixing belt 22. The induction heating unit 24 may include coils or exciting coils 25, a core portion or a exciting coil core 26, a coil guide 27, a cover 28, and so forth.

The coils or exciting coils 25 may include litz wires composed of thin wires bundled together. The litz wires may be twisted and extended in a width direction, that is, a horizontal direction of the FIG. 2.

The coil guide 27 may be formed of a relatively high heat-resistant resin material or any other suitable material. The coil guide 27 holds the coils 25 at a position opposite to the fixing belt 22.

The core portion 26 may be formed of a ferromagnetic material, for example, ferrite with a relative magnetic permeability of approximately 1000 to 3000. The core portion 26 may include a center core and a side core in order to form an efficient magnetic flux toward the fixing belt 22 and the first supporting roller 21.

The core portion 26 may be provided facing the coils 25 arranged in a width direction.

The cover 28 may be provided such that it covers the coils 25 and the core portion 26.

In addition, an inner core made of a ferromagnetic material, for example, ferrite, may be provided inside the supporting roller 21. A magnetic flux shielding member may be provided to cover a portion of the periphery of the inner core.

Although not shown, a thermistor is attached to the fixing belt 22. The thermistor may be a temperature sensitive element with a relatively sharp thermal response.

The thermistor may detect the temperature or the fixing temperature on the fixing belt 22. Based on the detection result of the thermistor, a thermal dose of the induction heating unit 24 may be adjusted.

The pressure roller 30 is formed of a cylindrical member 32 made of aluminum, copper, or any other suitable material on which the elastic layer 31 of a fluoro-rubber and the like is formed. The elastic layer 31 of the pressure roller 30 has a thickness of 0.5 to 2 mm, and a hardness of 60 to 90 on the Asker C scale.

The pressure roller 30 is pressed against the fixing auxiliary roller 20 through the fixing belt 22. The fixing belt 22 and the pressure roller 30 form a fixing nip. The recording medium P is transported to a place where the fixing belt 22 and the pressure roller 30 are in contact, that is, the fixing nip.

A description will now be given of an operation of the fixing unit 19 structured in a manner described above.

The fixing auxiliary roller 20 is rotatively driven by a drive motor (not shown), causing the fixing belt 22 and the supporting roller 21 to travel in the clockwise direction as shown in FIG. 2.

Furthermore, the pressure roller 30 rotates in the counterclockwise direction. The fixing belt 22 is heated at a position opposite to the induction heating unit 24.

A power source (not shown) supplies the coils 25 with a high-frequency alternating current of 10 kHz to 1 MHz, preferably 20 kHz to 800 kHz. Accordingly, a magnetic line of force may be formed in a manner such that the direction thereof may switch in both directions between the coils 25, and the supporting roller 21 and the fixing belt 22.

When the alternating magnetic field is formed in such a manner, an eddy current is generated on the surface of the supporting roller 21 and the exothermic layer of the fixing belt 22.

Joule heat is generated due to the electrical resistance of the supporting roller 21 and the exothermic layer. Thereby, the supporting roller 21 and the exothermic layer are heated.

In such a manner, the fixing belt 22 is heated by the heat emission of the supporting roller 21 and the heat of the exothermic layer of the fixing belt 22. In other words, the fixing belt 22 is directly heated by the induction heating unit 24, and indirectly heated by the induction heating unit 24 (through the supporting roller 21.)

Subsequently, the surface of the fixing belt 22 heated by the induction heating unit 24 arrives at a contact position where the surface of the fixing belt 22 comes into contact with the pressure roller 30.

The fixing belt 22 heats and fuses the toner image (T) or toner on the transported recording medium P.

The surface of the fixing belt 22 which has passed the fixing position arrives at a position opposite to the induction heating unit 24 again.

After such a sequence of the operation is continuously repeated, the fixing processing of the image forming processing in which the toner image is heated and pressed on the recording medium P is completed.

According to the first example embodiment, the power source to supply the electric power to the induction heating unit 24 is equipped with a main power source 61 and an auxiliary power source 62.

Figure 3:
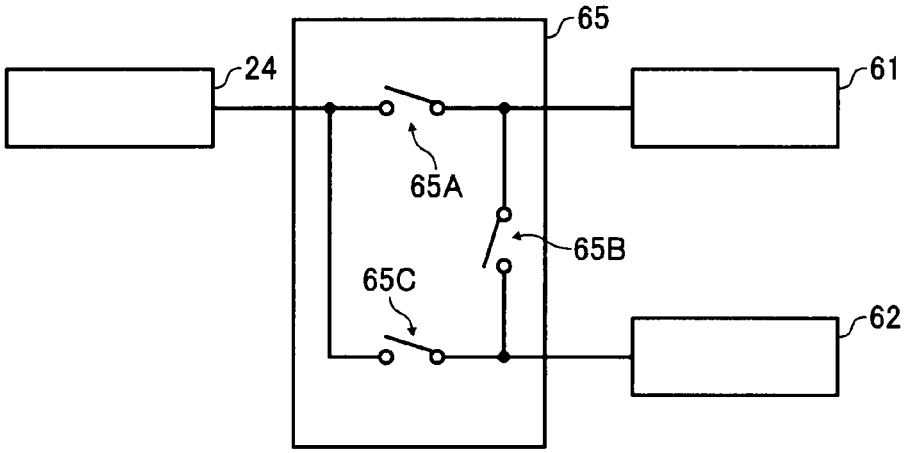
FIG. 3 is a block diagram illustrating a main power source and an auxiliary power source according to the example embodiment.

With reference to FIG. 3, the induction heating unit 24 may be supplied with the electric power from either the main power source 61 connected to a commercial power source or the auxiliary power source 62 capable of charging and discharging of the electric power.

As shown in FIG. 3, the induction heating unit 24 is connected to the main power source 61 and the auxiliary power source 62 by way of a switching circuit 65 including a plurality of switches 65A through 65C.

The main power source 61 is connected to the commercial power source or an outlet provided to a position where the image forming apparatus is installed.

The auxiliary power source 62 is provided with a capacitor capable of charging and discharging electric power. The capacitor of the auxiliary power source 62 may be an electric double-layer capacitor having a capacitance of approximately 2000 F and a capacity sufficient enough to supply electric power for a few seconds to a several tens of seconds.

The electric double-layer capacitor may be an electric double-layer capacitor manufactured by Nippon Chemi-Con Corporation.

When switching the plurality of switches 65A through 65C of the switching circuit 65, the main power source 61 and/or the auxiliary power source 62 may supply or break electric power to the induction heating unit 24, or the main power source 61 may supply electric power to the auxiliary power source 62 so as to charge the auxiliary power or the capacitor.

Figure 4:
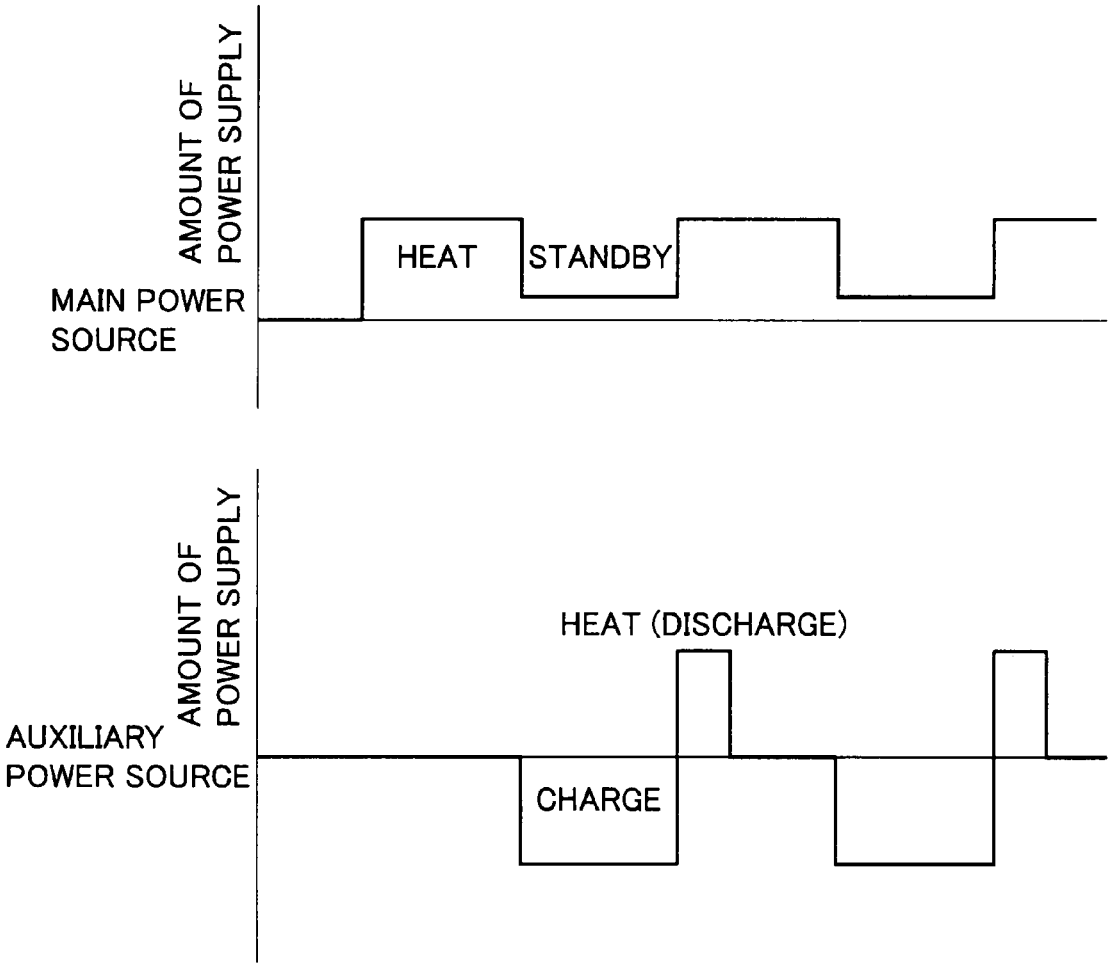
FIG. 4 is a wave form chart illustrating an amount of an electric power supply from the main power source and the auxiliary power source of FIG. 3.

Referring now to FIG. 4 there is shown a waveform chart illustrating an amount of electric power supply which is supplied to the induction heating unit 24 from the main power source 61 and the auxiliary power source 62.

As shown in FIG. 4, when the operation of the induction heating unit 24 is initiated, the switch 65A, that is, a first switch of the switching circuit 65 is connected. The electric power is supplied from the main power source 61 to the induction heating unit 24.

Accordingly, the temperature of the fixing belt 22 heated by the induction heating unit 24 increases to a desired temperature, and given fixing processing is performed.

When the induction heating unit 24 is in a standby state, that is, a state in which no significant heating may be necessary, the switch 65B or a second switch is connected so that the electric power is supplied from the main power source 61 to the auxiliary power source 62. Thereby, the auxiliary power source 62 is charged.

When the induction heating unit 24 starts to heat again recovering from the standby state, the first switch 65A and the third switch 65C are connected.

Accordingly, in addition to the power supply from the main power source 61 to the induction heating unit 24, the electric power is supplied or discharged from the auxiliary power source 62 to the induction heating unit 24.

The capacitor of the auxiliary power source 62 does not accompany a chemical reaction, when compared with a secondary battery. In other words, when the secondary battery, for example, a nickel-cadmium battery is used as an auxiliary power source, charging may take a number of hours.

On the other hand, when using a capacitor as an auxiliary power source, charging may be completed in a short period of time, for example, in a few minutes.

Therefore, in a case where the standby state and the heating state are repeated in a given time, the capacitor may be used as an auxiliary power source so that electric power is securely supplied from the auxiliary power source to the induction heating unit. Accordingly, an induction heating unit may attain a desired temperature in a short period of time.

Furthermore, a number of times the secondary battery, for example, a nickel-cadmium battery and the like, can be repeatedly charged or discharged may be limited to approximately 500 times to 1000 times.

Therefore, as an auxiliary power source, the product life cycle may be relatively short. Thus, replacement may be troublesome and may not be economical.

On the other hand, a capacitor may have a relatively long lifetime, and degradation caused by repeated charging and discharging is relatively small. In addition, unlike a lead-acid battery, it may not be necessary to replace or supply a liquid substance.

Thus, the maintenance of the capacitor may hardly be necessary, thereby making it possible to attain a stable use.

According to the first example embodiment, toner in the developer, that is, the toner for forming a toner image, stored in the developing unit 13, is prepared as follows:

dissolving or dispersing toner constituents including a prepolymer comprising a modified polyester resin and a compound capable of elongating or crosslinking the prepolymer in an organic solvent, to prepare a toner constituent solution or dispersion;

dispersing the toner constituent solution or dispersion in an aqueous medium, while subjecting the prepolymer and the compound to an elongation and/or a crosslinking reaction, to prepare a toner dispersion; and removing the organic solvent from the toner dispersion.

Furthermore, a number average particle diameter of the dispersed particles of a pigment colorant is no more than 0.5 μm. The content ratio of particles having a particle diameter of more than 0.7 μm may be no more than 5 percent.

The toner produced in a manner described above may realize low temperature fixability, a stable charging ability, and an enhanced fluidity. Therefore, a high quality image is achieved.

Specifically, in a color image forming apparatus, a color image with enhanced transparency and gloss is obtained.

Still furthermore, when toner produced in a manner such that the number average particle diameter of dispersed particles of the pigment colorant is no more than 0.3 μm, and the content ratio of particles having a particle diameter of more than 0.5 μm is no more than 10 percent is used, more enhanced quality image is obtained.

Such toner may provide an excellent image resolution. Thus, it is suitable for a digital image forming apparatus.

In a color image forming apparatus, resolution and transparency are enhanced, and a color image with high color reproducibility is achieved.

Alternatively, the toner constituents may further include a polyester resin unreactive to amine. Thereby, it is possible to enhance low temperature fixability and hot-offset resistant ability.

The toner used in the first example embodiment may be produced such that the following relationship is satisfied:

$$3.0 \leqq Dv \leqq 7.0 \text{ and}$$

$$1.00 \leqq Dv/Dn \leqq 1.20$$

where Dv (μm) is a volume average particle diameter, and Dn (μm) is the number average particle diameter.

The volume average particle diameter (Dv) is defined by the following formula:

$$Dv = [(\Sigma(nD^3)/\Sigma n)]^{1/3},$$

wherein n represents the number of the toner particles, and D represents the particle diameter.

The number average particle diameter (Dn) is defined by the following formula:

$$Dn = \Sigma(nD)/\Sigma n,$$

wherein n represents the number of the toner particles, and D represents the particle diameter.

Such toner has good heat-resistant preservation, low temperature fixability and hot-offset resistance. Therefore, a color image with an enhanced gloss may be obtained.

Furthermore, even if the toner is consumed and resupplied for an extended period of time in the two-component developer, fluctuation of toner particle diameter in the developer is insignificant. Thus, a stable development ability may be maintained even if agitation takes place for an extended period of time in the developing unit.

The volume average particle diameter and the number average particle diameter may be measured by using a particle size distribution measuring equipment such as Coulter Counter Model TA-2 or COULTER Multisizer 2 manufactured by Coulter Electronics Inc.

The toner used in the first example embodiment is a substantially spherical toner. The circularity thereof is in a range between 0.900 and 0.960.

Such toner may realize a high transferability and a high quality image without debris.

The circularity of the toner may be measured by dividing a peripheral length of a circle giving an identical area as the projection image by the peripheral length of an actual particle.

It may be measured by using the Sysmex FPIA-2000 Flow Particle Image Analyzer, for example.

Tetrahydrofuran-soluble components of the polyester resin in the toner may have a molecular weight distribution having a main peak in a range of 2500 to 10000, and a number average molecular weight in a range of 2500 to 50000.

Such toner allows an optimization of heat-resistant preservation so that low temperature fixability and a hot-offset resistant ability may be achieved.

The glass transition point of the polyester resin in the toner used in the first example embodiment is between 40 and 65 degree C., and an acid value may be 1 to 30 mgKOH/g.

Such toner may enhance low temperature fixability and a hot-offset resistant ability.

Figure 5:
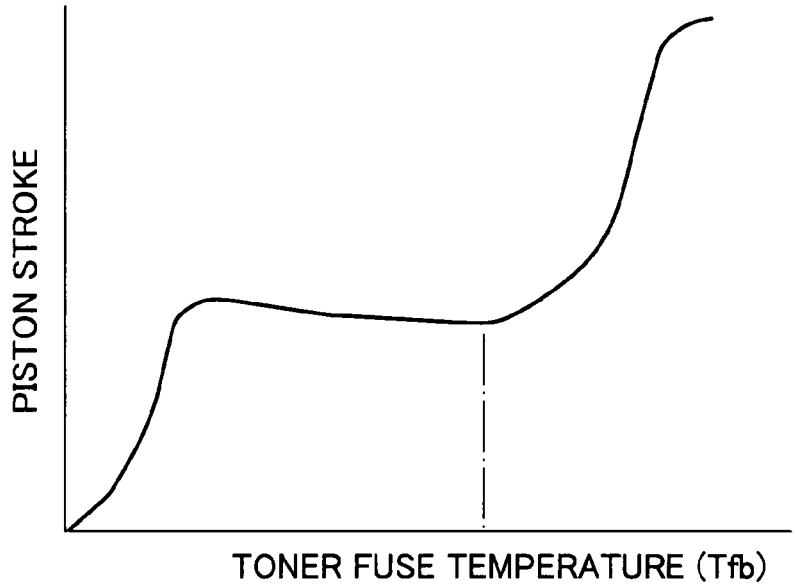
FIG. 5 is a graphical representation of a fuse characteristic of toner.

Referring now to FIG. 5 there is provided a graphical representation of a characteristic of fusing of the toner used in the first example embodiment.

As described above, when compared with the pulverized toner of the related art, the toner used in the first example embodiment realizes a high quality output image with an enhanced transparency and color saturation including brightness and gloss.

In addition, a powder fluidity, hot-offset resistance, a stable charging ability and transferability of the toner may be enhanced.

However, the toner used in the first example embodiment tends to slowly start to fuse under heat. The minimum fusing temperature is likely to be relatively high, for example, 92±1 degree C., when compared with the fusing temperature of 86±2 degree C. of the related art pulverized toner.

Therefore, the viscosity near the bottom temperature of the fixing control immediately after the power is turned on is likely to be a little high on the contrary to the pulverized toner.

Consequently, an adhesion of the toner relative to the fixing member increases, and the margin of the electrostatic offset relative to the fixing temperature may be less than the pulverized toner. In other words, the electrostatic offset tends to easily occur.

The minimum fusing temperature (Tfb) of the toner is defined as follows.

The minimum fusing temperature (Tfb) of the toner is measured by an elevated flow tester of CFT-500 C manufactured by Shimazu Corp.

FIG. 5 illustrates a flow curve measured by the flow tester allowing different temperature points to be read.

A dotted line shown in FIG. 5 indicates the minimum fusing temperature (Tfb). The measuring conditions are as follows:

Weight: 5 Kg/cm$^2$
Heating speed: 3.0 degree C./min
Diameter of a die: 1.00 mm
Length of the die: 10.0 mm Referring now to FIG. 6, a description will be given of wettability which is one of the surface characteristics of the fixing belt 22.

The wettablity herein refers to a maximum surface tension measured by a reagent which is an indicative of the wetness. The method and the reagent used in the measurement are in accordance with Japanese Industrial Standard (JIS) K6768.

When the value indicating wettablity is small, the reagent tends to be easily repelled, thereby making it difficult for a substance to stick.

Figure 6:
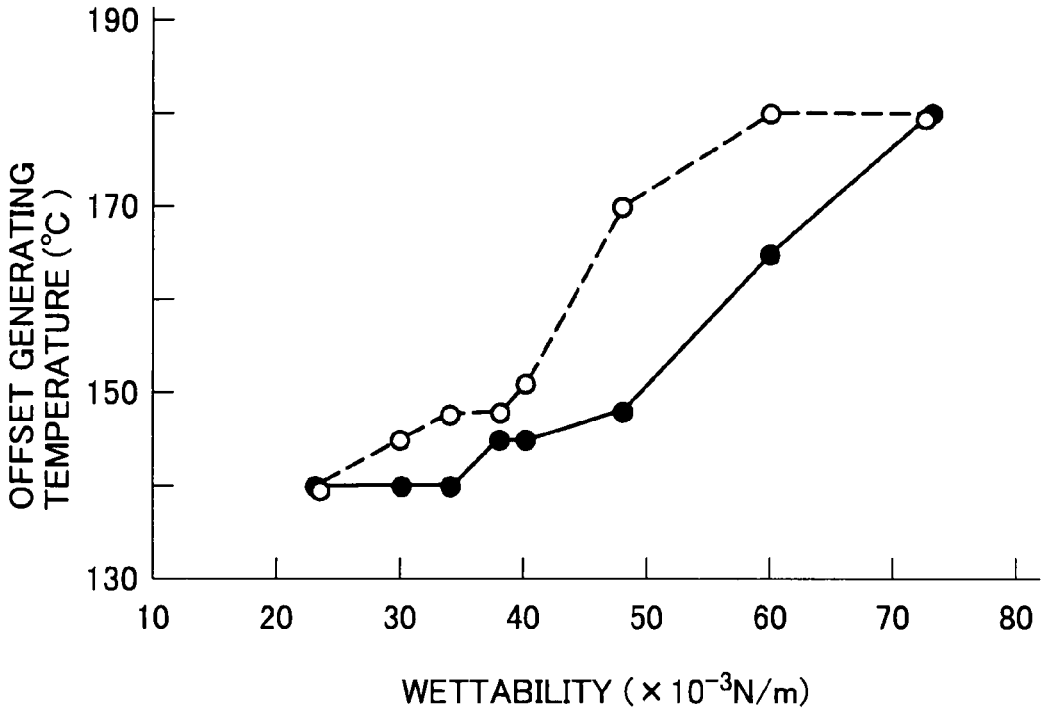
FIG. 6 is a graphical representation of a relationship between a wettability of a fixing member and an offset generating temperature.

FIG. 6 is a graphical representation of a relationship between the wettability of the peripheral surface of the fixing belt 22 (fixing member) and a temperature at which an electrostatic offset is generated. The temperature hereinafter refers to as an offset generating temperature.

An experiment was performed to measure the temperature at which the offset is generated using a plurality of the fixing belts 22 with different wettability.

In FIG. 6, the wettability of the fixing belt was plotted on a horizontal axis. A temperature (a maximum value) at which the electrostatic offset was generated was plotted on a vertical axis.

A solid line shown in FIG. 6 indicates a relationship between the wettablity and an offset generating temperature using a related art toner, that is, a pulverized toner.

On the contrary, a dotted line refers to a relationship between the wettability and an offset generating temperature using the toner used in the first example embodiment.

In the experiment using the related art toner, a silicone oil of 3 to 5 (mg/A4) was applied to the fixing belt surface as a release agent.

On the other hand, in the experiment using the toner used in the example embodiment, no silicone oil was applied on the fixing belt surface.

In FIG. 6, when using the related art toner, the electrostatic offset was generated when the surface temperature of the fixing belt 22 was 140 deg. C. and the wettability was 30 N/m.

In comparison, when using the toner used in the first example embodiment, the offset was generated when the surface temperature of the fixing belt 22 was higher than 140 deg. C. and the wettability was 30 N/m.

When using the toner used in the first example embodiment, the electrostatic offset was generated when the surface temperature of the fixing belt 22 was 180 deg. C., and the wettability was 60 N/m.

In comparison, when using the related art toner, the electrostatic offset was generated when the surface temperature of the fixing belt 22 was lower than 170 deg. C. and the wettability was 60 N/m.

In other words, the lower the offset generating temperature was, the more the margin relative to the electrostatic offset was provided.

Therefore, as illustrated in FIG. 6, the toner used in the first example embodiment has less margin relative to the electrostatic offset when compared with the related art toner.

In the image forming apparatus according to the first example embodiment, the surface temperature or the target temperature of the fixing belt 22 is regulated at 160 deg. C. during the fixing process so that sufficient fixability is secured.

However, the surface temperature of the fixing belt 22 may fluctuate between 150 and 170 deg. C., because the recording medium P may take the heat away from the fixing belt 22 during transportation of the recording medium P or an overshoot may occur between each sheet during continuous sheet feeding.

Therefore, as is illustrated in FIG. 6, depending on the wettability of the fixing belt 22, the electrostatic offset may be generated in the above temperature range. Consequently, there is a possibility that an abnormal image or a residual image may be generated.

In light of this, with reference to FIG. 6, when the surface temperature of the fixing belt 22 or the temperature at which the offset was generated was 150 deg. C., the offset was not generated even though the wettability of the fixing belt surface was approximately 50 (mN/m) when using the related art toner.

In comparison, when using the toner used in the first example embodiment, when the wettability of the fixing belt surface exceeded 38 (mN/m), the offset was generated.

In other words, when the wettability of the fixing belt surface is set to 50 (mN/m) using the toner used in the first example embodiment, it is necessary to set the minimum temperature of the fixing temperature to 170 degree C. Consequently, an extra energy needs to be consumed for the temperature difference of 20 degree C.

The toner used in the first example embodiment realizes a high quality image. However, the minimum fusing temperature (Tfb) is relatively high.

When the wettablity of the fixing belt surface is set to relatively high, for example, approximately 40 to 50 (mN/m), sufficient releaseability may not be secured.

Consequently, a small amount of toner remained on the fixing belt may adhere to the recording medium again after the fixing belt makes one rotation. When the toner firmly sticks to the fixing belt, an abnormal image due to a fixing problem may also be generated.

As a result of the experiment, in the first example embodiment, the wettability (measured by a method disclosed in Japanese Industrial Standard K6768) of the surface of the fixing belt 22 serving as a fixing member or the peripheral surface which comes into contact with the toner image is configured to be no more than 38 mN/m.

Thereby, even if the surface temperature of the fixing nip of the fixing unit 19 is regulated low, it is possible to reduce generation of the electrostatic offset, if not prevented.

Furthermore, it is possible to secure sufficient fixability with a little amount of energy and to reduce or prevent generation of an abnormal image.

As described above, according to the first example embodiment, the wettability of the surface of the fixing belt 22 serving as a fixing member is optimized. Therefore, it is possible to provide such a fixing unit and an image forming apparatus capable of reducing or preventing generation of the electrostatic offset with a relatively simple structure even if the oil-less toner is used as toner (T).

According to the first example embodiment, the fixing belt 22 and the supporting roller 21 are configured such that both the fixing belt 22 and the supporting roller 21 are heated by way of electromagnetic induction heating by the induction heating unit 24.

Alternatively, either the fixing belt 22 or the supporting roller 21 may be heated by way of electromagnetic induction heating by the induction heating unit 24.

For example, when the exothermic layer is not provided to the fixing belt 22, the supporting roller 21 may be heated by way of electromagnetic induction heating by the induction heating unit 24.

Accordingly, the supporting roller 21 may serve as a heating member which heats the fixing belt 22. In such a case, it is possible to achieve a similar, if not the same, effect as the effect of the first example embodiment.

Furthermore, according to the first example embodiment, the induction heating unit 24 is disposed at a position opposite to the peripheral surface of the fixing belt 22.

However, the induction heating unit 24 may be disposed facing the peripheral surface of the supporting roller 21. In other words, the induction heating unit 24 may directly face the supporting roller 21 without the fixing belt 22 therebetween.

Furthermore, instead of the fixing belt 22, a fixing roller having an exothermic layer may be used as a fixing member.

In such cases, it is possible to achieve the similar, if not the same, effect as the effect of the first example embodiment.

Figure 7:
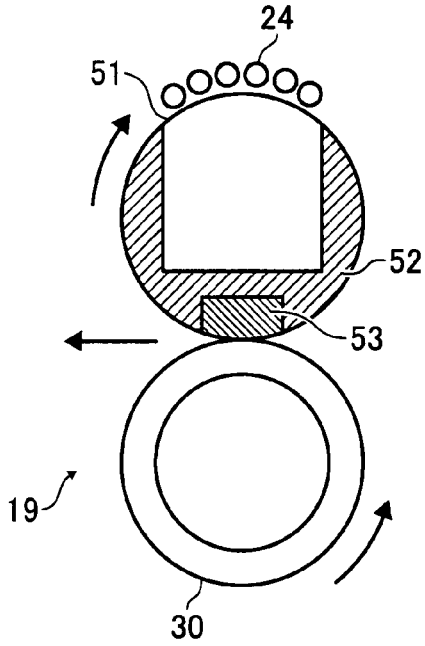
FIG. 7 is a cross-sectional view illustrating a fixing apparatus according to another example embodiment.

With reference to FIG. 7, a description will be given of a second example embodiment of the present invention.

Referring now to FIG. 7 there is shown a cross-sectional view illustrating the fixing unit 19 according to the second example embodiment.

The fixing unit 19 according to the second example embodiment is provided with a heat resistant film 51 serving as a fixing member, instead of the fixing belt 22 as a fixing member as seen in the first example embodiment.

As shown in FIG. 7, the fixing unit 19 according to the second example embodiment may at least include: the heat resistant film 51, a holder 52, an elastic member 53, the induction heating unit 24, a pressure roller 30 and so forth.

The heat resistant film 51 serves as a fixing member. The holder 52 is provided inside the heat resistant film 51 to hold the heat resistant film 51.

The elastic member 53 is provided inside the heat resistant film 51 so as to form a desired fixing nip.

Similar to the fixing belt 22 of the first example embodiment, the heat resistant film 51 includes an exothermic layer which is heated by way of electromagnetic induction heating by the induction heating unit 24.

A heat resistant release layer such as PTFE, PFA, FEP and so forth may be formed on the exothermic layer.

A film thickness of the heat resistant film 51 is no greater than 100 μm, preferably, approximately 20 to 50 μm According to the second example embodiment, the wettability (measured by a method disclosed in JIS K6768) of the peripheral surface of the heat resistant film 51 serving as a fixing member is configured to be no greater than 38 (mN/m).

In such a fixing unit 19, an alternating current of 10 k to 1 MHz is supplied to the induction heating unit 24 so that an alternating magnetic field is generated. Thereby, the heat resistant film 51 may be heated by way of electromagnetic induction heating.

Accordingly, the heat resistant film 51 heated by way of electromagnetic induction heating heats and fuses the toner image on the recording medium P transported in a direction shown by an arrow, and fixes the toner image on the recording medium P.

Similar to the first example embodiment, in the second example embodiment, the wettability of the surface of the heat resistant film 51 serving as the fixing member is optimized.

Therefore, it is possible to provide such a fixing unit and an image forming apparatus capable of reducing or preventing the electrostatic offset with a relatively simple structure even if the oil-less toner is used as toner (T).

Figure 8:
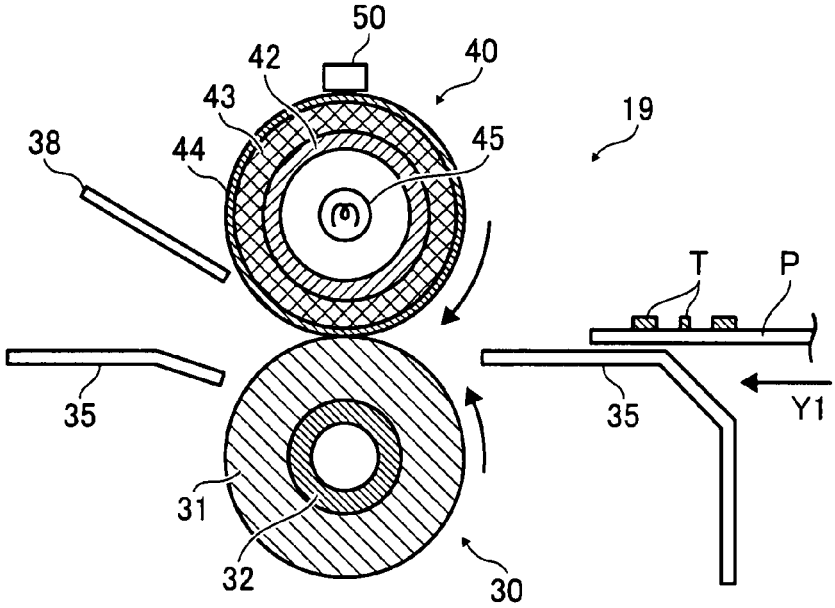
FIG. 8 is a cross-sectional view illustrating a fixing apparatus according to another example embodiment.

With reference to FIG. 8, a description will be given of a third example embodiment of the present invention.

Referring now to FIG. 8 there is shown a cross-sectional view illustrating the fixing unit 19 according to the third example embodiment.

The fixing unit 19 according to the third example embodiment uses heating method using a heater lamp and include a heater 45 serving as a heat source.

In contrast, the fixing unit 19 of the first and second example embodiments use the electromagnetic induction heating method.

As shown in FIG. 8, the fixing unit 19 according to the third example embodiment may at least include: a fixing roller 40 serving as a fixing member, the pressure roller 30 serving as a pressure member, a temperature sensor or a thermistor 50, guide plates 35, a separation plate 38 and so forth.

The fixing roller 40 serving as the fixing member is formed of a thin cylinder member which rotates in a direction shown by an arrow in FIG. 8.

The heater 45 is fixedly provided inside the cylinder member.

The fixing roller 40 has a multilayered structure in which an elastic layer 43 and a release layer 44 are sequentially laminated on a metal shaft 42. The fixing roller 40 abuts the pressure roller 30 serving as a pressure member to form a nip.

The metal shaft 42 of the fixing roller 40 is formed of an iron-type material such as SUS304 and the like.

An elastic material, for example, a fluoro-rubber, a silicone rubber and a foam silicone rubber or the like is used for the elastic layer 43 of the fixing roller 40.

A perfluoro alkyl vinyl ether copolymer resin (PFA), a polyimide, a polyetherimide, a polyether sulfide (PES) and the like may be used for the release layer 44 of the fixing roller 40.

When the release layer 44 is provided to the surface layer of the fixing roller 40, releaseability or separability relative to toner (T) or the toner image is maintained.

According to the third example embodiment, the wettability (measured by a method disclosed in Japanese Industrial Standard K6768) of the peripheral surface of the fixing roller 40 serving as a fixing member is configured to be no more than 38 (mN/m).

The heater 45 of the fixing roller 40 is a halogen heater with a capacity of approximately 1200 W. Both ends of the heater 45 are fixed to a side plate of the fixing apparatus 19.

The output of the heater 45 may be controlled by the power source (AC power supply) of the image forming apparatus. The heater 45 heats the fixing roller 40. The surface of the fixing roller 40 heats the toner image T on the recording medium P.

The temperature sensor or the thermistor 50 which abuts the front surface of the fixing roller 40 detects the temperature of the roller surface. Based on the temperature of the roller surface detected by the temperature sensor 50, the output of the heater 45 is controlled.

By controlling the output of the heater 45, it is possible to adjust the temperature of the fixing roller 40 or the fixing temperature at a desired temperature (a target control temperature).

The temperature sensor 50 may be a thermistor of a contact type. Alternatively, the temperature sensor 50 may be a non-contact type thermopile or the like.

The pressure roller 30 at least includes the metal shaft 32. The peripheral surface thereof includes the elastic layer 31 by way of an adhesive layer.

The elastic layer 31 of the pressure roller 30 may be formed of a fluoro-rubber, a silicone rubber, a foam silicone rubber or the like.

The surface layer of the elastic layer 31 may include a thin release layer formed of PFA or the like.

A pressure mechanism (not shown) presses the pressure roller 30 against the fixing roller 40. Accordingly, a desired fixing nip is formed between the pressure roller 30 and the fixing roller 40.

The guide plates 35 for guiding the recording medium P are provided at both an entry side and an exit side of a contact portion which is the fixing nip of the fixing roller 40 and the pressure roller 30. The guide plates 35 are fixedly provided to the side plates of the fixing unit 19.

The separation plate 38 is provided at a position opposite to the peripheral surface of the fixing roller 40 in a vicinity of the exit side of the fixing nip. The separation plate 38 reduces or prevents the recording medium P after the fixing process from winding around the fixing roller 40 along with a rotary motion of the fixing roller 40.

Instead of the separation plate 38, a separation claw may be provided.

A description will now be given of an operation of the fixing apparatus 19 having the above-described structure.

When the image forming apparatus is turned on, an alternating voltage is applied (or supplied) to the heater 45 from the alternating current power supply.

The fixing roller 40 and the pressure roller 30 start to rotate in a direction shown by an arrow shown in FIG. 8.

Subsequently, the recording medium P is supplied from the sheet feeding unit. An unfixed image is carried on the recording medium P in the image forming unit.

The recording medium P bearing the unfixed image T, that is, a toner image, is transported in an arrow Y direction as shown in FIG. 8. Thereby, the recording medium P is transported into the fixing nip between the fixing roller 40 and the pressure roller 30.

Subsequently, the toner image T is fixed on the recording medium P by the heat from the fixing roller 40 and the pressure of the fixing roller 40 and the pressure roller 30.

Similar to the first and second example embodiments, in the third example embodiment, the wettability of the surface of the fixing roller 40 serving as the fixing member may be optimized.

Therefore, it is possible to provide such a fixing unit and an image forming apparatus capable of reducing or preventing the electrostatic offset with a relatively simple structure even if the oil-less toner is used.

Figure 9:
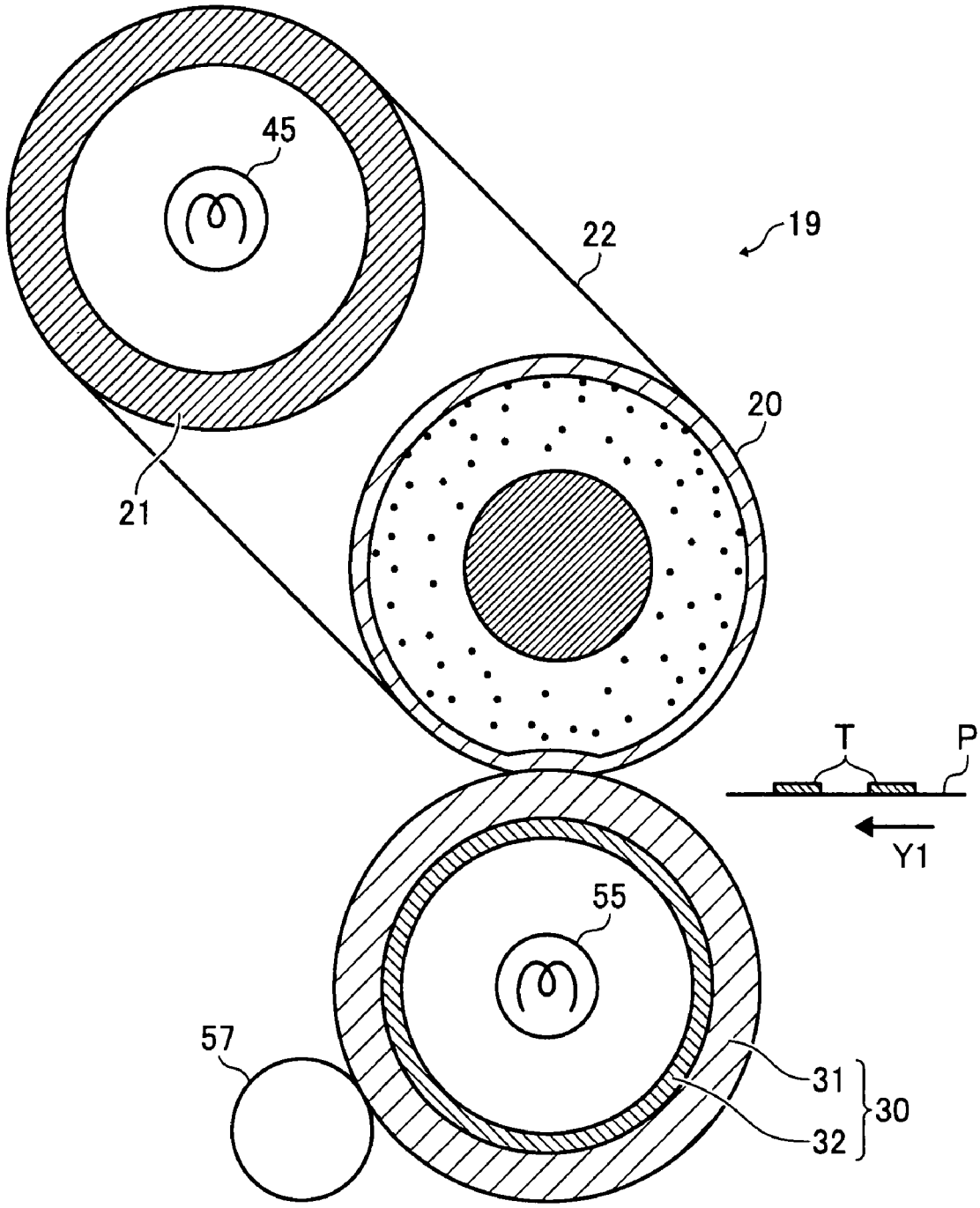
FIG. 9 is a cross-sectional view illustrating a fixing apparatus according to another example embodiment.

With reference to FIG. 9, a description will be given of a fourth example embodiment of the present invention.

Referring now to FIG. 9 there is shown a cross-sectional view illustrating the fixing unit 19 according to the fourth example embodiment.

The fixing unit 19 according to the fourth example embodiment uses the fixing belt 22 serving as a fixing member and the pressure roller 30 provided with a heater 55 and an oil application roller 57 serving as an oil supply mechanism.

As shown in FIG. 9, the fixing unit 19 according to the fourth example embodiment may at least include: the fixing belt 22 serving as a fixing member, the supporting roller 21, the fixing auxiliary roller 20, the pressure roller 30 serving as a pressure member, the oil application roller 57 serving as an oil supply mechanism and so forth.

The fixing belt 22 is structured in a substantially similar, if not the same, manner as the fixing belt 22 according to the first example embodiment, except that the fixing belt 22 according to the fourth example embodiment does not include an exothermic layer.

According to the fourth example embodiment, the wettability (measured by a method disclosed in Japanese Industrial Standard K6768) of the peripheral surface of the fixing belt 22 serving as a fixing member is configured to be no greater than 38 (mN/m).

The heater 45 disposed inside the supporting roller 21 may be a halogen heater with a capacity of approximately 1100 W.

The heater 55 disposed inside the pressure roller 30 is a halogen heater with a capacity of approximately 200 W.

Such a structure allows the supporting roller 21 and the pressure roller 30 to heat the fixing belt 22.

The basic operation of the fixing unit 19 according to the fourth example embodiment may be substantially similar to, if not the same as, the operation of the first example embodiment, except that the fixing unit 19 of the fourth example embodiment uses a heating method using a heater.

Thus, the description of the basic operation is omitted herein.

According to the fourth example embodiment, in order to enhance the releasablity between the fixing belt 22 and the toner, the oil application roller 57 serving as an oil supply mechanism is provided such that the oil application roller 57 comes into contact with the peripheral surface of the pressure roller 30.

The oil application roller 57 includes a metal shaft around which a sponge-like foam member impregnated with a silicone oil is provided.

A translucent film having fine pores is wound once or twice around the periphery of the foam member.

Thereby, the oil application roller 57 allows the silicone oil of the foam member to exude through the translucent film so that a small amount of oil is applied to the contacting pressure roller 30.

The surface layer of the oil application roller 57 is formed of a material having a good releaseability, for example, GORE-TEX (registered trademark) so as to prevent toner from adhering to the surface of the oil application roller 57 even if jamming of the recording medium P occurs, and toner adheres to the surface of the pressure roller 30.

When toner adheres to the surface of the oil application roller 57, the fine pores from which the oil exudes may be clogged, thereby preventing the oil application roller 57 from applying the oil.

The silicone oil exuded from the oil application roller 57 is applied to the pressure roller 30 and the fixing belt 22 through the pressure roller 30.

The amount of the silicon oil to be applied is small, for example, approximately 0.05 to 0.08 (mg/A4) so that the releaseability is enhanced. However, the offset may not be completely prevented.

As described above, according to the fourth example embodiment, the wettability of the peripheral surface of the fixing belt 22 may be optimized. Accordingly, even if the minimum fusing temperature of toner is relatively high, less energy may be necessary to secure an optimal fixability.

According to the fourth example embodiment, the wettability (measured by a method disclosed in Japanese Industrial Standard K6768) of the surface of the pressure roller 30 serving as a pressure member or the peripheral surface which comes into contact with the fixing member is configured to be no more than 38 mN/m.

When the surface property of the pressure roller 30 as a pressure member is significantly different from the surface property of the fixing belt 22 as a fixing belt 22, paper dust or the like transferred from the recording medium P may adhere thereto.

Specifically, when the oil application roller 57 serving as an oil supply mechanism is disposed, the amount of the oil applied to the pressure roller 30 and the amount of the oil applied to the fixing belt 22 are not balanced.

Consequently, there may be such a problem that the oil adheres to an output image in a granular manner.

In light of the above, according to the fourth example embodiment, the surface property of the pressure roller 30 and the surface property of the fixing belt 22 are configured to be similar, if not the same. Accordingly, it is possible to suppress the above-described problem.

According to the fourth example embodiment, the pressure roller 30 is used as a pressure member. However, when using a pressure belt and a heat resistant film as a pressure member, the similar, if not the same, effect as the effect of the fourth example embodiment may be achieved.

As described above, according to the fourth example embodiment, the wettability of the surface of the fixing belt 22 serving as a fixing member is optimized.

Therefore, it is possible to provide such a fixing unit and an image forming apparatus capable of reducing or preventing the electrostatic offset with a relatively simple structure even if the oil-less toner is used.

Furthermore, elements and/or features of different example embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

One or more embodiments of the present invention may be conveniently implemented using a conventional general purpose digital computer programmed according to the teachings of the present specification, as will be apparent to those skilled in the computer art.

Appropriate software coding can readily be prepared by skilled programmers based on the teachings of the present disclosure, as will be apparent to those skilled in the software art.

One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Furthermore, any of the aforementioned methods may be embodied in the form of a program. The program may be stored on a computer readable media and is adapted to perform any one of the aforementioned methods, when run on a computer device (a device including a processor).

Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of a built-in medium include, but are not limited to, rewriteable non-volatile memories, such as ROMs and flash memories, and hard disks.

Examples of a removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such example variations are not to be regarded as a departure from the spirit and scope of the present invention, and all such modifications as would be obvious to one skilled in the art are intended to be included within the scope of the following claims.

What is claimed is:

1. A fixing unit for fixing a toner image on a recording medium, comprising:

a fixing member to heat and melt a toner, the fixing member including a surface formed of fluoroethylene resin contacting the toner image and including a wettability not greater than 38 mN/m when measured in accordance with Japanese Industrial Standard (JIS) K6768, wherein the surface temperature of the fixing member during the fixing process is between 150° C. and 170° C.

2. The fixing unit according to claim 1, wherein the fixing member includes at least one of a fixing roller, a fixing belt and a heat-resistant film.

3. The fixing unit according to claim 1, further comprising:

a pressure member, forming a nip when coming into contact with the fixing member, the pressure member including a surface contacting the fixing member and including a wettability not greater than 38 mN/m.

4. The fixing unit according to claim 3, wherein the pressure member includes at least one of a pressure roller, a pressure belt and a heat-resistant film.

5. The fixing unit according to claim 3, further comprising:

an oil applicator in surface contact with the pressure member.

6. The fixing unit according to claim 1 further comprising:

a main power source to connect to a commercial power source; and an auxiliary power source to charge and discharge an electric power, wherein the electric power is supplied from at least one of the main power source and the auxiliary power source.

7. The fixing unit according to claim 1, wherein the toner is prepared by a method comprising:

at least one of dissolving and dispersing toner constituents including a pigment colorant, a prepolymer including a modified polyester resin, and a compound capable of at least one of elongating and crosslinking the prepolymer in an organic solvent, to prepare at least one of a toner constituent solution and a toner constituent dispersion;

dispersing at least one of the toner constituent solution and the toner constituent dispersion in an aqueous medium, while subjecting the prepolymer and the compound to at least one of an elongation and a crosslinking reaction, to prepare a toner dispersion; and removing the organic solvent from the toner dispersion, wherein the pigment colorant has a number average dispersion particle diameter of not greater than 0.5 μm, and a content ratio of particles having a particle diameter of not less than 0.7 μm not greater than 5 percent.

8. The fixing unit according to claim 7, wherein the number average dispersion particle diameter of the pigment colorant is not greater than 0.3 μm, and the content ratio of particles have a particle diameter of not less than 0.5 μm not greater than 10 percent.

9. The fixing unit according to claim 7, wherein the toner constituents further comprise a polyester resin unreactive to amine.

10. The fixing unit according to claim 1, wherein the following relationships are satisfied:

$$3.0 \leqq Dv \leqq 7.0 \text{ and}$$

$$1.00 \leqq Dv/Dn \leqq 1.20$$

wherein Dv (μm) is the volume average particle diameter of the toner, and Dn (μm) is the number average particle diameter thereof.

11. The fixing unit according to claim 1, wherein the toner has a circularity of 0.900 to 0.960.

12. The fixing unit according to claim 1, wherein tetrahydrofuran-soluble components of polyester resin in the toner have a molecular weight distribution having a main peak in a range of 2500 to 10000, and a number average molecular weight in a range of 2500 to 50000.

13. The fixing apparatus according to claim 12, wherein the polyester resin has a glass transition temperature of 40° C. to 65° C. and an acid value of 1 to 30 mg KOH/g.

14. An image forming apparatus, comprising:

a photosensitive drum;

a charger to charge the photosensitive drum;

a writing unit to irradiate the photosensitive drum to form an electrostatic latent image thereon;

a developing unit configured to develop the electrostatic latent image with a developer including a toner to form a toner image on the photosensitive drum;

a transfer unit to transfer the toner image onto a recording medium; and a fixing unit as claimed in claim 1, to fix the toner image on the recording medium.

15. The image forming apparatus of claim 14, wherein the developer comprises a toner and a carrier.

16. The fixing unit according to claim 1, wherein the fixing member is a fixing roller that includes a heat resistant film as the fixing member, a holder provided inside the heat resistant film to hold the heat resistant film and an elastic member provided inside the heat resistant film that forms a fixing nip.

17. The fixing unit according to claim 1, wherein the fixing unit does not include a mechanism for applying a release agent to the fixing unit.

18. The fixing unit according to claim 1, wherein the toner includes a polyester resin.

19. The fixing unit according to claim 1, wherein the wettability is greater than 30 mN/m.

* * * * *